United States Patent [19]

Jachowski et al.

[11] Patent Number: 4,644,303

[45] Date of Patent: Feb. 17, 1987

[54] MULTIPLE CAVITY SQUARE PRISM FILTER TRANSMITTER COMBINER WITH SHARED SQUARE WALLS AND TUNING CONTROLS MOUNTED ON RECTANGULAR END WALLS

[75] Inventors: Ronald E. Jachowski, Paradise Valley; Donald C. Dickson, Phoenix, both of Ariz.

[73] Assignee: Orion Industries, Inc., Cleveland, Ohio

[21] Appl. No.: 589,132

[22] Filed: Mar. 13, 1984

[51] Int. Cl.[4] ..... H01P 1/213; H01P 7/06

[52] U.S. Cl. ..... 333/134; 333/136; 333/202; 333/230; 333/231; 333/232; 333/229

[58] Field of Search ..... 333/202, 208, 209–212, 333/219, 227, 228, 230, 231, 232, 234, 235, 134, 135, 136, 137; 455/54, 95, 101, 120, 121, 124; 370/38, 123

[56] References Cited

U.S. PATENT DOCUMENTS

| | | | |
|---|---|---|---|
| 2,246,928 | 6/1941 | Schock | 334/41 X |
| 2,424,267 | 7/1947 | Carter | 333/208 |
| 2,427,100 | 9/1947 | Kihn | 333/231 X |
| 2,444,066 | 6/1948 | Rostas | 333/232 |
| 2,492,996 | 1/1950 | Haxby | 333/232 |
| 2,533,741 | 12/1950 | Okness | 333/232 X |
| 2,550,409 | 4/1951 | Fernsler | 333/231 X |
| 2,630,488 | 3/1953 | Clegston | 333/232 |
| 2,736,868 | 2/1956 | Bell, Jr. | 333/231 |
| 3,480,889 | 11/1969 | Kach | 333/229 |
| 3,673,522 | 6/1972 | Bastikar | 333/212 |
| 3,882,434 | 5/1975 | Levy | 333/212 |
| 4,001,737 | 1/1977 | Scott | 333/232 |
| 4,112,398 | 9/1978 | Burnett et al. | 333/208 X |
| 4,157,515 | 6/1979 | de Bayser et al. | 333/209 X |
| 4,246,555 | 1/1981 | Williams | 333/209 |
| 4,396,896 | 8/1983 | Williams | 333/212 |

FOREIGN PATENT DOCUMENTS

| | | | |
|---|---|---|---|
| 1211298 | 2/1966 | Fed. Rep. of Germany | 333/232 |
| 2484715 | 12/1981 | France | 333/135 |
| 581533 | 11/1974 | U.S.S.R. . | |

*Primary Examiner*—Eugene R. LaRoche
*Assistant Examiner*—Benny T. Lee
*Attorney, Agent, or Firm*—Dressler, Goldsmith, Shore, Sutker & Milnamow, Ltd.

[57] ABSTRACT

A transmitter combiner includes a plurality of adjacent square prism filters, each of which shares at least one square wall with another of filters. Tuning of the individual square prism filters is accomplished by adjusting the position of tuning rods located in the high electric field region of each cavity. Tuning of each filter is achieved by rotating a control rod perpendicular to and extending through a rectangular end wall to pivot the tuning rod in that filter. In one embodiment of the invention, the control rod extends through a conductive tube attached along a square wall of the filter and perpendicular to the rectangular wall. In another embodiment of the invention, the control rod extends from the center of the rectangular wall and supports the tuning element near the center of the cavity. Temperature compensation is accomplished by variation in the length of the control rod as a function of temperature to compensate for changes in the dimensions of the cavity with the temperature thereof. In another embodiment of the invention, a bi-metal element shielded from electromagnetic energy in the cavity by a conductive tube causes pivoting of a small tuning rod.

28 Claims, 21 Drawing Figures

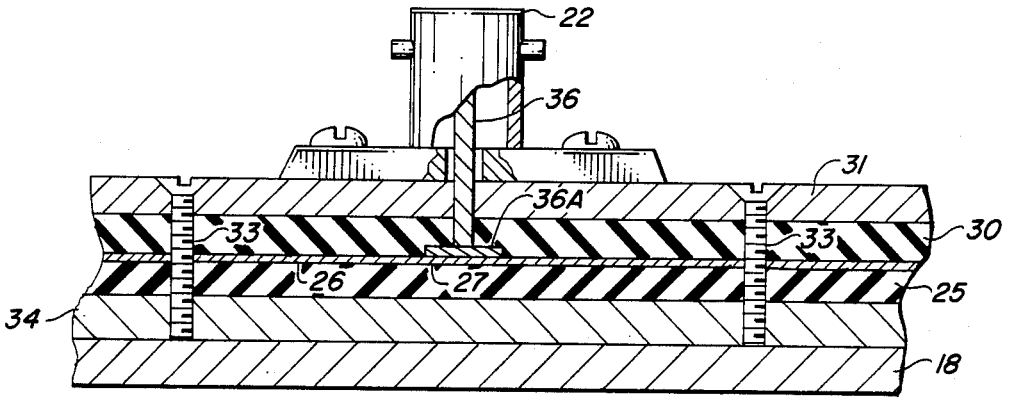
FIG. 17
FIG. 20
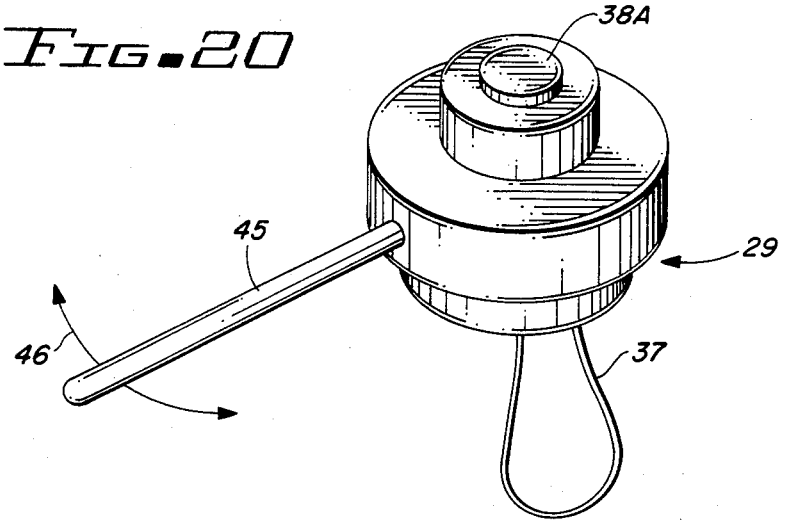
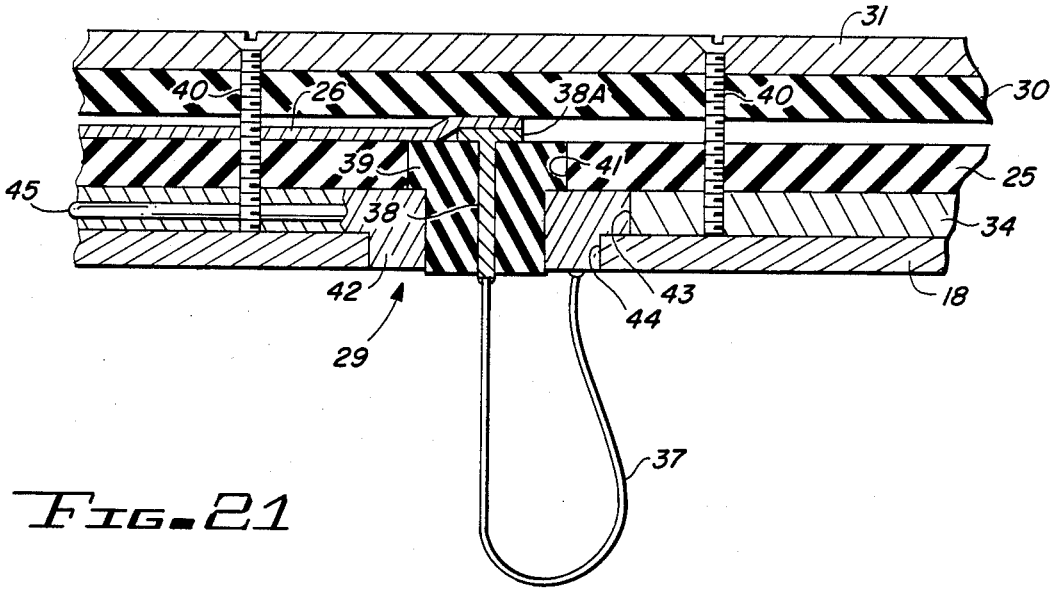
FIG. 21

MULTIPLE CAVITY SQUARE PRISM FILTER TRANSMITTER COMBINER WITH SHARED SQUARE WALLS AND TUNING CONTROLS MOUNTED ON RECTANGULAR END WALLS

BACKGROUND OF THE INVENTION

The invention relates to square prism filters, and more particularly to transmitter combiners including a plurality of contiguous square prism filters.

Transmitter combiners are devices which allow simultaneous transmission of signals from a plurality of transmitters at different closely spaced frequencies by means of a single antenna. Transmitter combiners include a number of tuned cavities, one corresponding to each transmitter and each frequency. Each bandpass (or band reject) filter is coupled by a coaxial cable to a separate respective transmitter and is also coupled to a common coaxial connector to which the single antenna is connected. Until recently, the vast majority of transmitter combiners in use have been constructed of coaxial tuned cavities, rather than square prism filters (cavities) because most mobile communication systems have operated in assigned 150 megahertz and 450 megahertz bands. The sizes of square prism filters operable at these frequencies are so large that it was more practical (from a space savings point of view) to use coaxial tuned cavities than square prism filter cavities. More recently, an 880 megahertz band has been allocated for mobile telephone communications. In this band, square prism filters having dimensions of approximately 9 inches by 9 inches by 3 inches are practical. Holders of FCC licenses in this band have established "cells" or regions in major metropolitan areas, each cell being typically several miles in extent, each having a low power antenna that, generally is centered in that cell in a major metropolitan areas. Recent rapid growth of the mobile telecommunication market has greatly increased the number of antennas needed. Antenna sites in metropolitan areas are very expensive. Therefore, there is a great deal of incentive to provide small, compact transmitter combiners for use at such antenna sites. Although it would seem that square prism filters, due to their rectangular parallel piped structure, could more easily be arranged in space saving configurations than coaxial tuned filters, the fact is that it has always been necessary to tune square prism filters from controls located on the outer geometric center portions of a square face of a square prism filter. This has prevented "stacking" square prism filters together or building large multiple cavity devices with shared square walls. Positioning of the tuning controls for square prism filters near the center of the square walls has been necessitated by the fact that the tuning rods or elements should extend into a portion of the cavity near, or at least aligned with the geometric center of the cavity in order to be effective and in order to provide adequate tuning control without introducing unacceptably large amounts of insertion loss. Those skilled in the art know that, as a general matter, insertion of any conductive element into a tuned cavity causes insertion loss which, of course, must be minimized in any state of the art tuned cavity device.

It is clear that there is an unmet need for a compact multiple tuned cavity device and, more particularly, for compact high performance transmitter combiners.

SUMMARY OF THE INVENTION

Accordingly, it is an object of the invention to provide a compact, low cost transmitter combiner composed of square prism filters which can be conveniently joined at the square walls thereof.

It is another object of the invention to provide a compact, low cost transmitter combiner including a plurality of square prism filters respectively joined with like square prism filters at their square walls, and to provide an accurate, inexpensive means of temperature compensation for the square prism filter.

It is another object of the invention to provide a means and method for achieving effective tuning of a square prism filter by means of controls located on a rectangular, rather than a square wall thereof without introducing appreciable insertion loss.

Briefly described, and in accordance with one embodiment thereof, the invention provides an apparatus and method for tuning a square prism filter from the outside surface of a rectangular, rather than square wall thereof by pivotally supporting a first tuning element or rod near or in approximate alignment with the center of the cavity by means of a first rotatable rod disposed in a plane perpendicular to that rectangular wall and extending through that rectangular wall and connected to an external tuning control thereon, although if the first rotatable rod is composed of low lass dielectric material it can be outside of the perpendicular plane referred to. But if the first rotatable rod is composed of metal or high loss dielectric material, it must lie in the perpendicular plane. In a described embodiment of the invention, the square prism filter is included in a transmitter combiner that also includes a plurality of additional identical square prism filters, each of which has a square wall common with at least one of the other square prism filters. Tuning controls, frequency pointers and calibrated frequency scales are disposed on a front rectangular wall of each of the square prism filters. A transmitter cable coaxial connector on an opposed back rectangular wall of each square prism filter is connected to an internal probe extending into that cavity. Another internal probe of the cavity is electrically connected to a strip transmission line conductor that conducts a corresponding filtered transmitter signal from each cavity to a centrally located coaxial connector, which is coupled to a single coaxial antenna cable. In one described embodiment of the invention, in each square prism filter a first rotatable rod extends in a first conductive tube that is soldered along the inner conductive surface of a square wall of that cavity from a first pivotal tuning rod of that cavity to a rectangular wall of that cavity. The first rotatable rod extends through a hole in that rectangular wall and is coupled to a control handle which can be rotated in order to rotate the rod and the tuning rod to tune the cavity. A second conductive tube parallel to the first conductive tube is soldered along the conductive inner surface of the above-mentioned square wall of that cavity. A temperature sensitive bi-metal element disposed within the second conductive tube is connected to rotate a second rotatable rod. The inner end of the second rotatable rod is connected to a second smaller pivotal tuning rod. The bi-metal element rotates enough, as the temperature of the square wall varies, to compensate for changes in the dimensions of that square prism filter and thereby cause the tuning rod attached thereto to tune the cavity to keep its resonant frequency constant with respect to temperature. The second conductive tube prevents electromagnetic energy within the cavity from directly heating the bi-metal element and causing compensation errors.

In another described embodiment of the invention, the first rotatable rod is tubular, and a third rotatable rod extends through the first rotatable rod. A third tuning element is connected to the inner end of the third rotatable rod. The outer end of the third rotatable rod is connected to a "fine tuning" handle outside of the first rectangular wall, so that the first handle can be used to effectuate "coarse tuning" of the frequency of the cavity and the second handle can be used to effectuate "fine tuning" of the cavity.

In another presently preferred described embodiment of the invention, a conductive rotatable rod is supported in cantilever fashion by an electrically conductive reduction bearing mechanism located in the center of a rectangular wall of a square prism filter. The rotatable rod is composed of a material having a coefficient of expansion such that as the temperature of the cavity varies, the length of the rotatable rod varies enough to cause a transverse tuning rod attached thereto to compensate for changes in the dimensions of the square prism filter, and thereby keep the resonant frequency of that square prism filter constant with respect to temperature. In another embodiment of the invention, the rotatable rod is supported at both ends by conductive bearings disposed in or near the center portions of opposite rectangular walls of the square prism filter.

BRIEF DESCRIPTION OF THE DRAWINGS

FIG. 17 is a partial section view taken along section line 17—17 of FIG. 5.

FIG. 20 is a perspective view of an adjustable probe loop assembly to which the outer ends of the strip lines in FIG. 16 make electrical contact.

FIG. 21 is a section view illustrating the strip tranmission line assembly included in FIGS. 4 and 5 and the probe loop assembly of FIG. 20.

DESCRIPTION OF THE INVENTION

Figure 1:
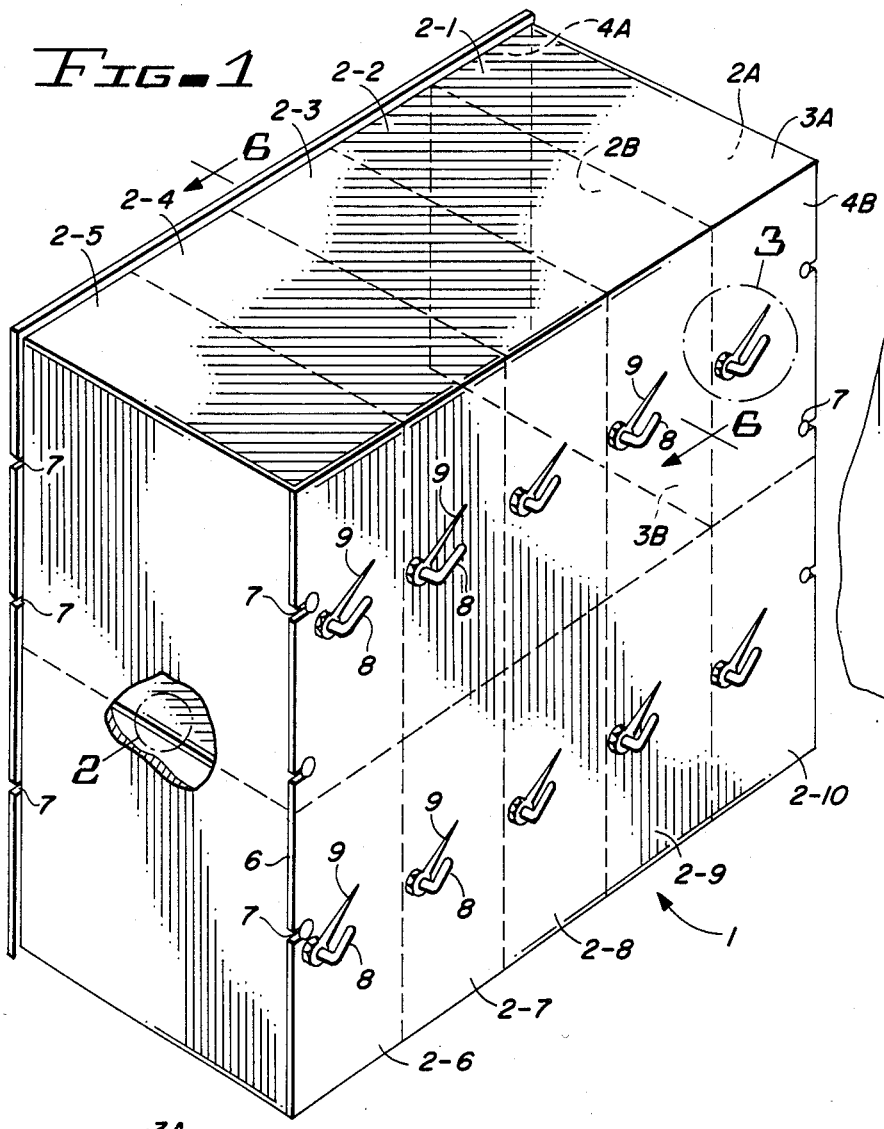
FIG. 1 is a perspective view illustrating the front, side and top of a transmitter combiner unit of the present invention.
Figure 2:
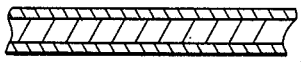
FIG. 2 is an enlarged view of detail 2 in FIG. 1.
Figure 3:
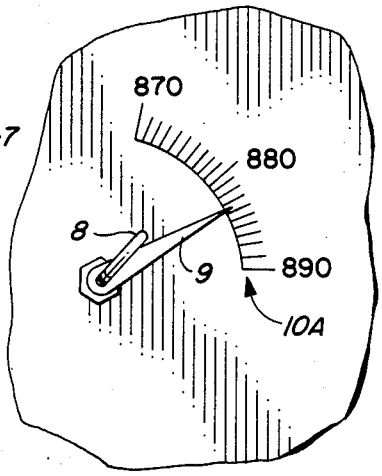
FIG. 3 is an enlarged plan view of detail 3 in FIG. 1.

Referring now to the drawings, especially FIGS. 1–8, transmitter combiner 1 includes 10 square prism filters, including 2-1, 2-2, . . . 2-10. Each of the square prism filters includes two square conductive walls which are spaced apart and parallel and two pairs of rectangular walls which are perpendicular to the square walls, connected so as to form a rectangular parallelipiped. For example, square prism filter 2-1 includes square walls 3A and 3B. Square prism filter 2-1 also includes rectangular walls 4A and 4B, which form the top and bottom walls of square prism filter 2-1. Square prism filter 2-1 also includes two more rectangular walls 2A and 2B which form the rear and front walls of square prism filter 2-1.

Hereinafter, the square sides will be referred to as "square walls" and the four other sides comprising the front, rear, top and bottom walls of each square prism filter will be referred to as "rectangular walls", wherein the largest dimension of each rectangular wall is equal to the dimension of a square wall, and the other dimension of each rectangular wall is substantially less than the dimension of one of the square walls, despite the fact that the mathematical definition of "rectanqular" includes "square". For example, the square walls are approximately 9 inches square and the rectangular walls are approximately 9 inches by 3 inches in the 880 MHz square prism filters specifically described herein.

The front walls, such as 4B of the square prism filters are all comprised in a front mounting panel 6. Mounting panel 6 has a number of notches, such as 7, which enable the transmitter combiner unit 1 to be bolted to a conventional 19 inch equipment rack. (Alternately, the individual square prism filters can be constructed as boxes, each having a missing square wall, which are soldered together so that each missing wall of one box is replaced by a square wall of an adjoining box.)

The square prism filters all share at least one square wall with an adjoining square prism filter. For example, square prism filter 2-1 has its inner square wall 2B common with adjoining square filter prism 2-2. All of the square prism filters also share a common rectangular wall. For example, square prism filter 2-1 has its bottom wall 3B shared with square prism filter 2-10. The bottom wall 3B of square prism filter 2-1 is the top wall of square prism filter 2-10.

The material of which the various walls of the square prism filters and transmitter combiner 1 are composed is preferably copper clad Invar material, since this metal has a very low, positive temperature coefficient, so that over the normal temperature operating range of −30 degrees Centigrade to +60 degrees Centigrade, the dimensions of the square prism filters do not change significantly. Consequently, the resonant frequency of each cavity remains essentially unchanged with respect to temperature. Since Invar is quite expensive, a low cost embodiment of the transmitter combiner 1 may instead be formed of cold rolled steel, coated with copper. In either case, the cross-sectional view of each wall has the appearance indicated in FIG. 2, which is an enlarged view of detail 2 in FIG. 1.

On the front of each square prism filter of the transmitter combiner 1, there is a tuning control handle 8, a frequency pointer 9 and a frequency calibrated scale 10.

Figure 4:
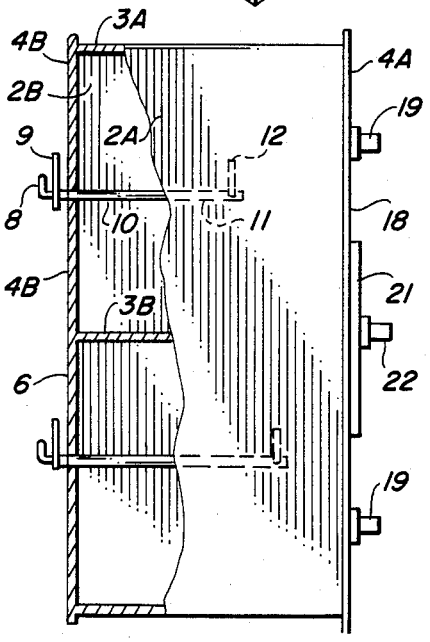
FIG. 4 is a partial cutaway side view of the transmitter combiner shown in FIG. 1.
Figure 6:
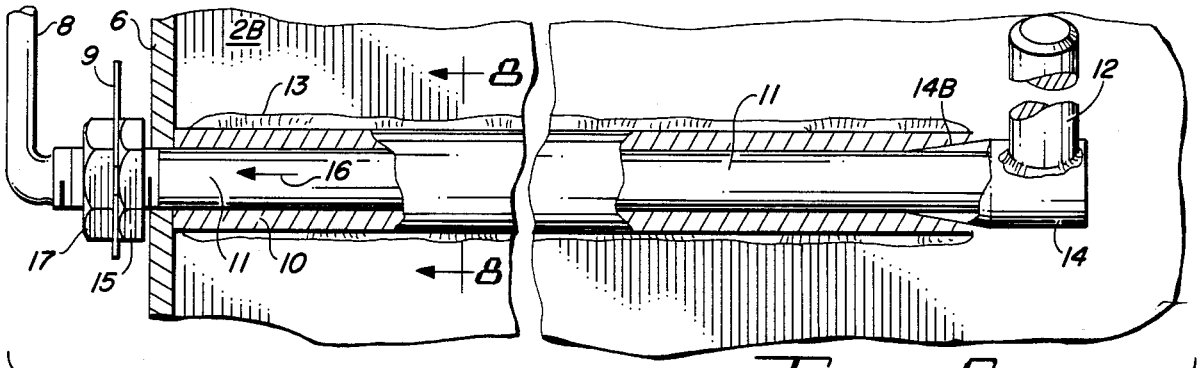
FIG. 6 is a partial section view taken along section line 6—6 of FIG. 1.
Figure 7:
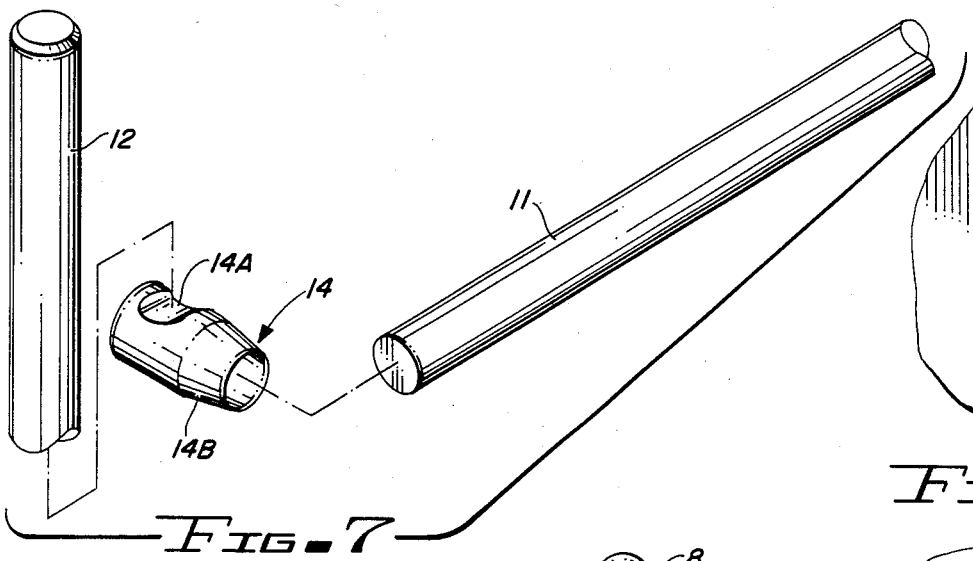
FIG. 7 is an enlarged exploded view showing the connection of a tuning element to the rotatable rod illustrated in FIG. 6.
Figure 8:
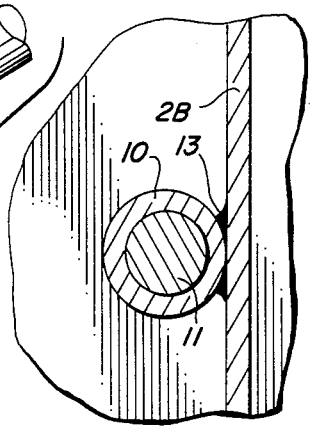
FIG. 8 is an enlarged partial section view taken along section line 8—8 of FIG. 6.

As best seen in FIGS. 4 and 6, each handle 8 is connected to a rotatable rod 11 which extends through a conductive tube 10. Conductive tube 10 is rigidly attached by means of a silver solder connection 13 along the inner surface close to and parallel to the center line of one of the square walls of the square prism filter. At the opposite end of rotatable rod 11, as best seen in FIG. 6, there is a connector 14. In each connector 14, there is a transverse hole 14A (FIG. 7) into which an Invar conductive tuning element or rod 12 is inserted and soldered.

Each connector 14 has a tapered bearing surface 14B which fits in precise, intimate electrical and mechanical contact with the a tapered mouth opening of conductive tube or sleeve 10. A nut 15 at the opposite or handle end of each rod 11 tightens rod 11 (FIG. 6) to ensure that the tapered bearing surface 14B maintains tight, intimate electrical contact with the mating frusto-conical mouth opening at the inner end of conductive sleeve 10. A second nut 17 tightens frequency pointer or needle 9 onto rod 11. Also see FIG. 8, which is a sectional view along section line 8—8 of FIG. 6 for a further view of the structure shown in FIG. 6.

Preferably, conductive sleeve 10, rotatable rod 11, and pivotal tuning rod 12 are composed of Invar.

Figure 5:
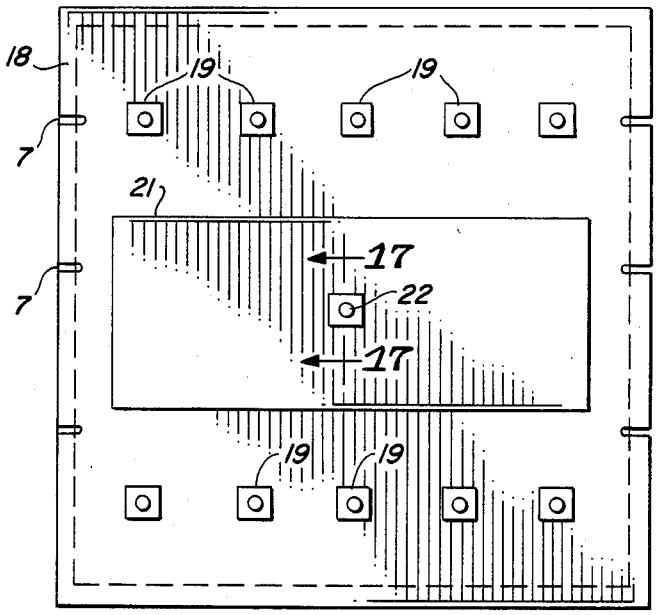
FIG. 5 is a back elevation view of the transmitter combiner shown in FIG. 1.
Figure 19:
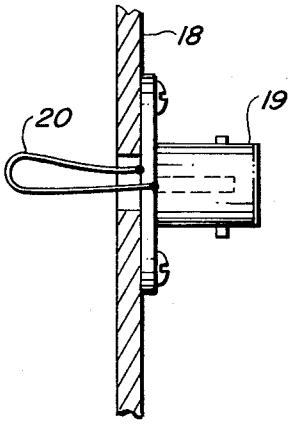
FIG. 19 is a partial section view showing a typical coaxial connector and internal probe loop attached to the transmitter cable coaxial connection to each of the square prism filters in the transmitter combiners of FIGS. 1, 13 and 14.

Referring now to FIGS. 4 and 5, rear panel 18 of transmitter combiner unit 1 comprises the rear walls of all of the square prism filters. Reference numeral 7 again indicates the slots that can be used to bolt rear panel 18 to a conventional 19 inch equipment rack. At the center of each of the rear walls of the respective square prism filters, there is a coaxial connector 19 to which a coaxial transmitter cable (not shown) is connected. The center conductor of each of the transmitter cable coaxial connectors 19 is connected to one end of an internal probe or loop 20, as shown in FIG. 19. The other end of the conductive loop 20 is grounded to the base or outside of coaxial connector 19. As those skilled in the art will recognize, the loop or probe 20 excites the resonant cavity of a square prism filter in response to the transmitter signal, causing the square prism filter to exhibit its characteristic band pass or band reject properties at the resonant frequency of that square prism filter.

Also attached to the rear panel 18 is a strip transmission line assembly 21. An antenna cable coaxial conductor 22 is mounted on the center of strip transmission line assembly 21 for connection to a single antenna cable (not shown) that leads up an antenna tower for direct connection to the antenna elements.

Figure 15:
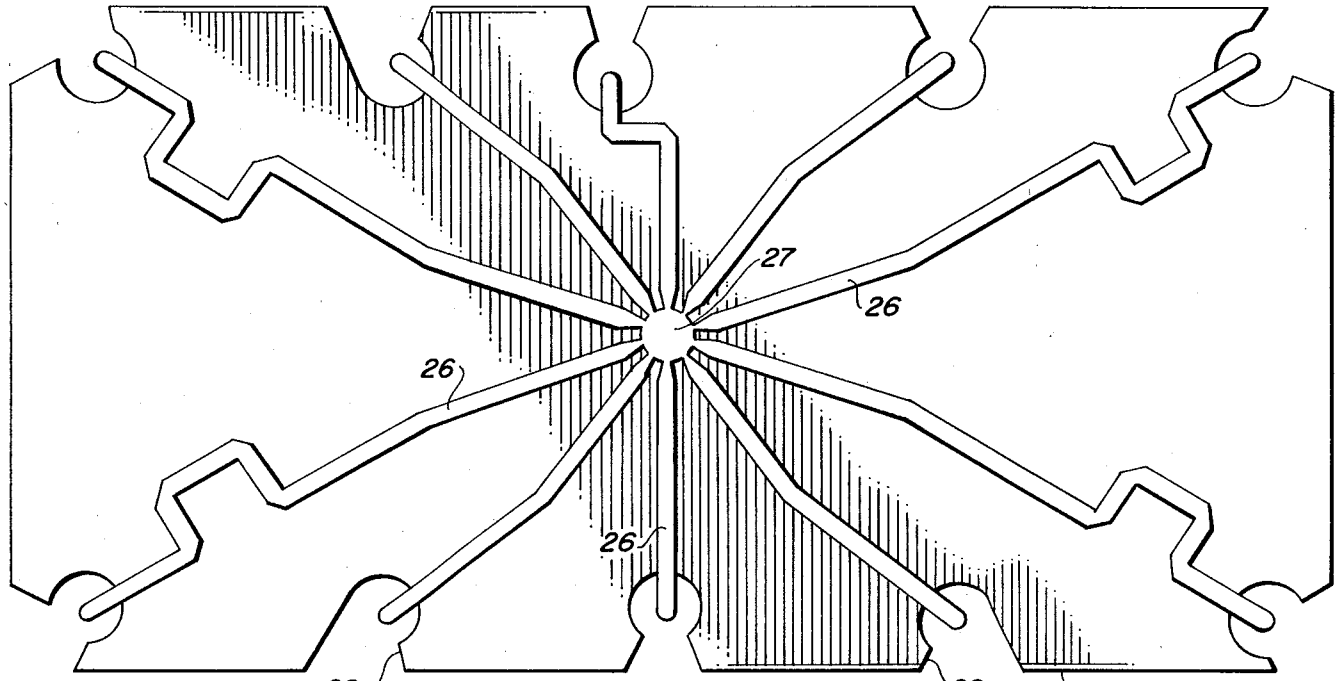
FIG. 15 is a plan view of strip line connector board of a strip transmission line assembly attached to the back surface of the transmitter combiner unit of FIGS. 1, 13 and 14.

FIGS. 15–21 show the details of strip transmission line assembly 21. Strip transmission line assembly 21 facilitates feeding of the filtered individual transmitter signals from the various coaxial connectors 19 to a single antenna cable coaxial connector 22. Referring now to FIG. 15, an insulator plate 25 is shown. It can be composed of, for example, REXOLITE dielectric material.

Figure 18:
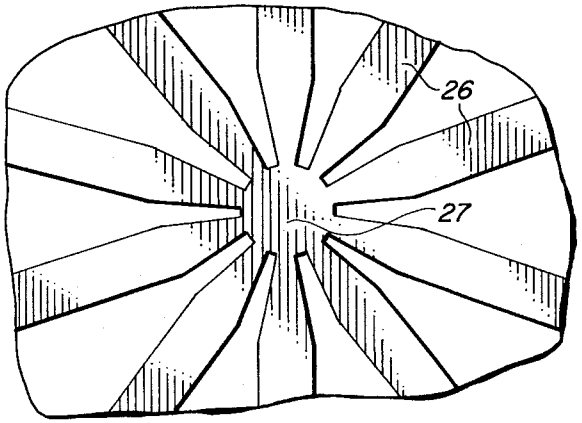
FIG. 18 is an enlarged partial plan view of the junction of the strip transmission lines shown in FIG. 15.

A plurality of strip transmission lines, such as 26 are patterned on the upper surface of insulator plate 25. The strip transmission lines 26 all are connected to and integral with a center pad 27, to which the center conductor of coaxial antenna cable connector 22 makes electrical contact, as subsequently explained. Each of the strip lines 26 extends outward over a semicircular cutaway portion 28 of insulator plate 25 to make electrical connection to and allow rotation of a tuning probe assembly such as 29 of FIGS. 20 and 21. The cutaway portion 28 of insulator plate allows rotation of tuning probe asembly 29, as subsequently explained. FIG. 18 shows the intersection of the strip transmission lines 26 at pressure contact pad 27 more clearly.

Figure 16:
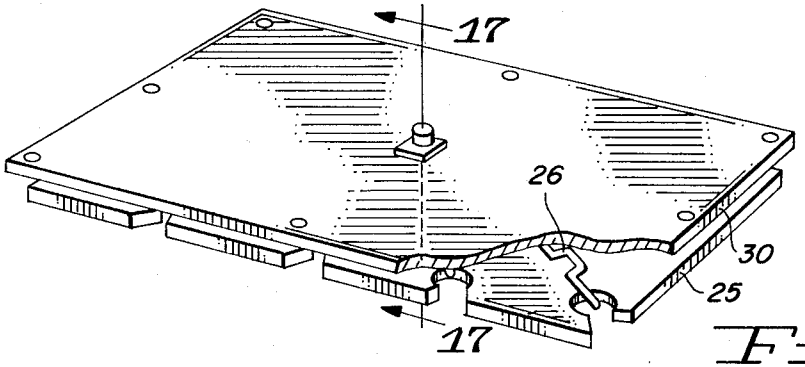
FIG. 16 is a partial cutaway perspective view of a partial assembly including the strip transmission line connector board of FIG. 15.

In FIG. 16, insulator plate 25 is shown with an upper insulator plate 30 thereon.

Referring to FIG. 17, a section view is shown along section line 17—17 of FIG. 5. In this figure, it can be seen that antenna cable coaxial connector 22. is bolted onto the top of a metal ground plate 31, which is preferably composed of Invar metal. Metal plate 31 is drawn tightly against an upper insulator plate 30 by means of metal screws such as 33 which engage threaded holes and a lower metal ground plate 34, which, can be composed of Invar metal. Insulator plate 30 rests upon and is drawn tightly against a second insulator plate 25.

The center conductor of antenna cable coaxial connector 22 is designated by reference numeral 36. This center conductor 36 includes a long stud, having an enlarged head 36A. Head 36A is forced downward by metal plate 31 and insulator plate 30 against the enlarged center pad 27 of a strip line supported by an insulator plate 25. Reference numeral 26 in FIG. 17 designates two of the strip transmission lines emanating from pressure contact pad 27. The force produced by metal screws 33 produces the necessary force to press head 36A against contact pad 27 to ensure reliable electrical contact thereto. Preferably, lead 36A is soldered to contact pad 27.

Next, the means by which the outer ends of the various strip line conductors 26 communicate with the interior of the various square prism filter cavities is explained with reference to FIGS. 20 and 21. Basically, the outer end of each of the strip transmission line conductors 26 makes pressure contact to a conductive copper probe loop 37 which extends into the interior of a corresponding square prism filter cavity to detect the filtered transmitter output signal produced by the cavity in response to the signal received by means of the transmitter coaxial cable connector 19. As best seen in FIGS. 20 and 21, each probe loop 37 has one end connected to a center stud 38 which extends through a cylindrical insulator block 39 of a tuning probe assembly 29. The head of each stud 38 is enlarged, as indicated by reference numberal 38A, and makes electrical contact with the lower surface of the strip transmission line conductor 26 under which the particular probe loop assembly is positioned. The needed force to acheive reliable electrical contact between strip line 26 and stud head 38A is obtained by means of the metal screws 40, which force upper ground plate 31 and upper insulator plate 30 down upon the upper surface of the strip transmission line conductors 36. Insulator plate 25 has a round hole 41 therein through which the upper cylindrical portion of insulator 39 fits. The lower cylindrical portion of insulator 39 has a smaller diameter, and extends through a cylindrical hole in a copper collar 42. Cylindrical copper collar 42 has an upper portion of enlarged diameter which extends through a hole 43 in bottom metal ground plate 34, which can be composed of copper clad Invar metal. The cylindrical lower portion of copper collar 42 is of smaller diameter, and extends through a hole 44 in the metal wall 18 of the square prism filter in which the probe loop 37 tuning probe assembly 29 extends.

Each tuning probe assembly 29 has a tuning arm 45 which can be manipulated to cause the tuning assembly to rotate in the direction indicated by arrows 46 to effectuate precise initial tuning of a particular square prism filter. The selected orientation of the probe loop 37 can then be locked into position by tightening the adjacent screws 40.

The foregoing description refers to only one of numerous possible embodiments of the invention. Another presently preferred embodiment of the invention is shown in FIG. 13, wherein the rotatable rods are not enclosed in a conductive sleeve, but instead are supported in cantilever fashion from a suitable bearing mounted in the center of a rectangular end wall and support the copper clad Invar tuning rod at a location within about one inch of the geometrical center of the cavity.

Figure 13:
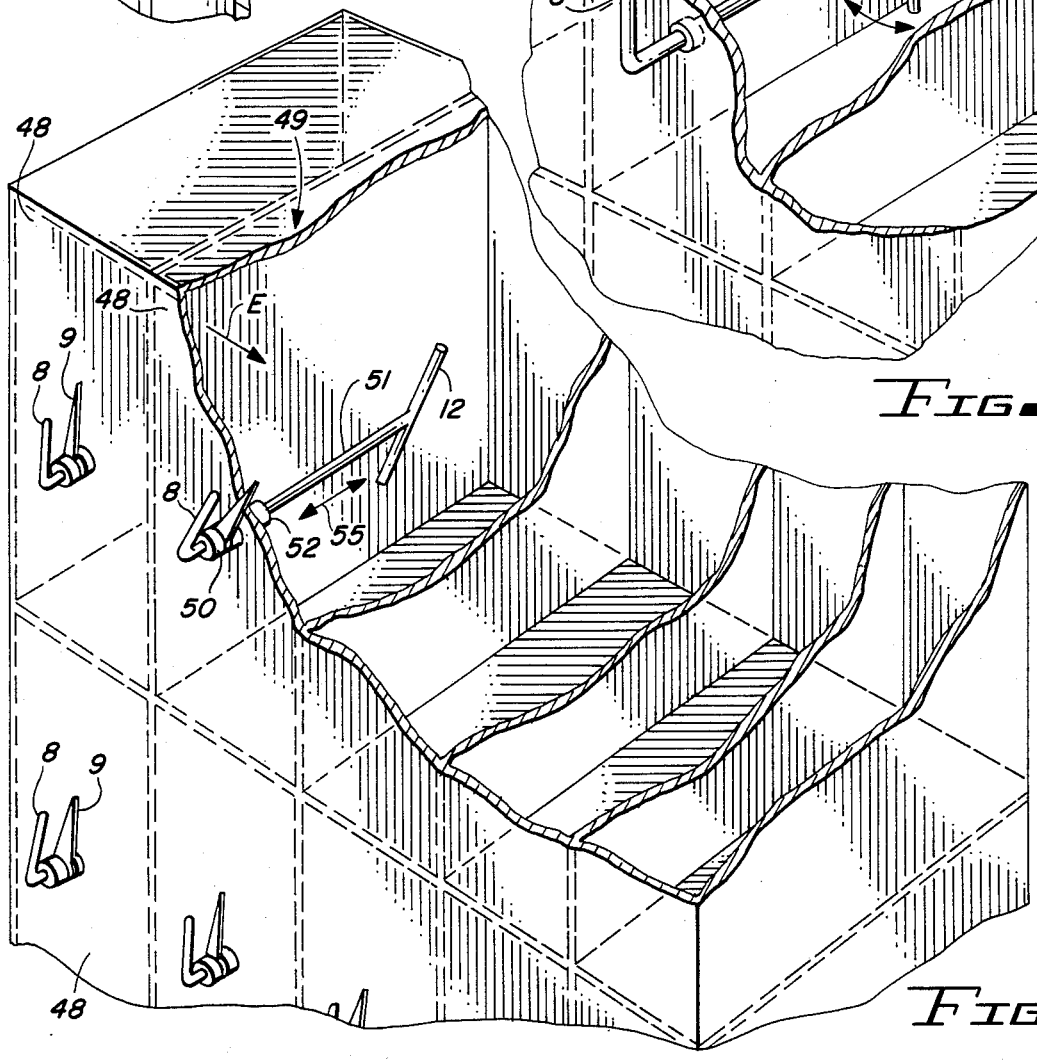
FIG. 13 is a partial perspective cutaway view of another embodiment of the invention.

Referring now to FIG. 13, a plurality of square prism filter cavities are shown in which the handles 8 and the indicator pointers 9 are shown in the centers of the rectangular wall 48. Each of the square prism filters shown shares a common square wall with at least one other of the square prism filters comprising the transmitter combiner unit 1A. Referring particularly to square prism filter 49, which is shown in a perspective cutaway view, its tuning handle 8 is connected to a reduction mechanism 50, which produces a "fine tuning" capability. Approximately ten rotations of tuning handle 8 will produce one rotation of rotatable cantilever shaft 51. Rotatable cantilever shaft 51 is supported in a suitable bearing 52 which is integral with reduction mechanism 50. Various suitable reduction/bearing mechanisms can be used, such as a 10:1 epicyclic drive made by JB Company of Great Britain, designated by its catalog part number 5857. It provides intimate electrical contact of the rotatable cantilever-supported rod 51 to the conductive material (preferably copper coated Invar metal) of which the walls of the square prism filters are composed. Our experiments have indicated that cantilever rod 51 is best composed of aluminum for an embodiment of the invention intended to operate in the 880 megahertz band, wherein the approximate size of each square prism filter is approximately 9 inches $\times$9 inches $\times$3 inches. The tuning rod 12 has its midpoint connected to the inner end of cantilever rod 51. The tuning rods described herein are preferably composed of Invar, but could also be other materials, such as copper, copper tubing, or possibly even dielectric material, as long as the presence of the material can distort the electric field in a suitable way.

In the embodiment of the invention described herein with reference to FIG. 13, the Invar tuning rod 12 is approximately 2 inches long. Its diameter is approximately 0.25 inches. Our experiments have shown that with the aluminum cantilever rod 51, having a length such that the axis of tuning rod 12 lies in a plane approximately one inch from the geometric center of cantilever rod 51, the electric field variation within the cavity performed by square prism filter 49 is such that the relatively large thermal expansion of the length of cantilever rod 51 precisely compensates for the decrease in resonant frequency of the square prism filter 49 which would otherwise occur as a result of the slight thermal expansion of the Invar material as the temperature of the square prism filter 49 increases. It is to be noted that the construction shown in FIG. 13 is such that the cantilever rod 51 is precisely perpendicular to the rectangular wall 48 and tuning rod 12 is perpendicular to the axis of cantilever rod 51. However, it is not necessary that tuning rod 12 be perpendicular to cantilever rod 51, or that the tuning element 12 even be a rod. If cantilever element 51 is conductive, or is of high loss dielectric material, it should be in a plane that is perpendicular to rectangular wall 48. The electric field pattern inside the cavity of square prism filter 49 is such that the presence of aluminum support rod 51 has no appreciable effect on the resonant frequency of square prism filter 49 and introduces no appreciable insertion loss.

Figure 14:
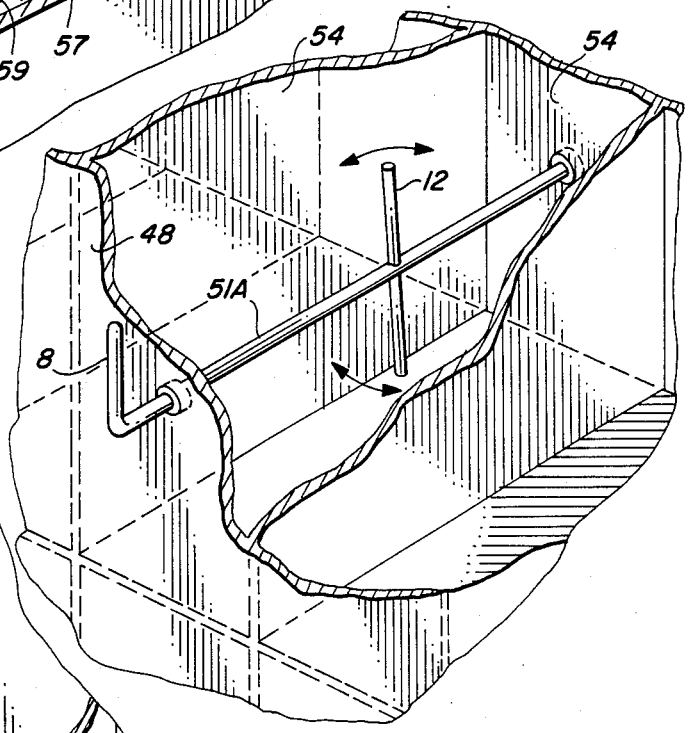
FIG. 14 is a partial cutaway perspective view of yet another embodiment of the invention.

Referring next to FIG. 14, another variation on the device of FIG. 13 is shown, wherein the rod 51A is not supported in cantilever fashion as in FIG. 13, but extends all the way from the front rectangular wall 48 to the center of the rear rectangular wall 54. Again, the horizontal rod 51A does not affect the resonant frequency or produce insertion loss. This embodiment of the invention should be particularly useful for double tuned square prism filters in which the common wall 54 is not square, but instead has its length in the horizontal direction doubled, possibly making it impractical to support the Invar tuning element 12 in the cantilever fashion shown in FIG. 13.

Figure 12:
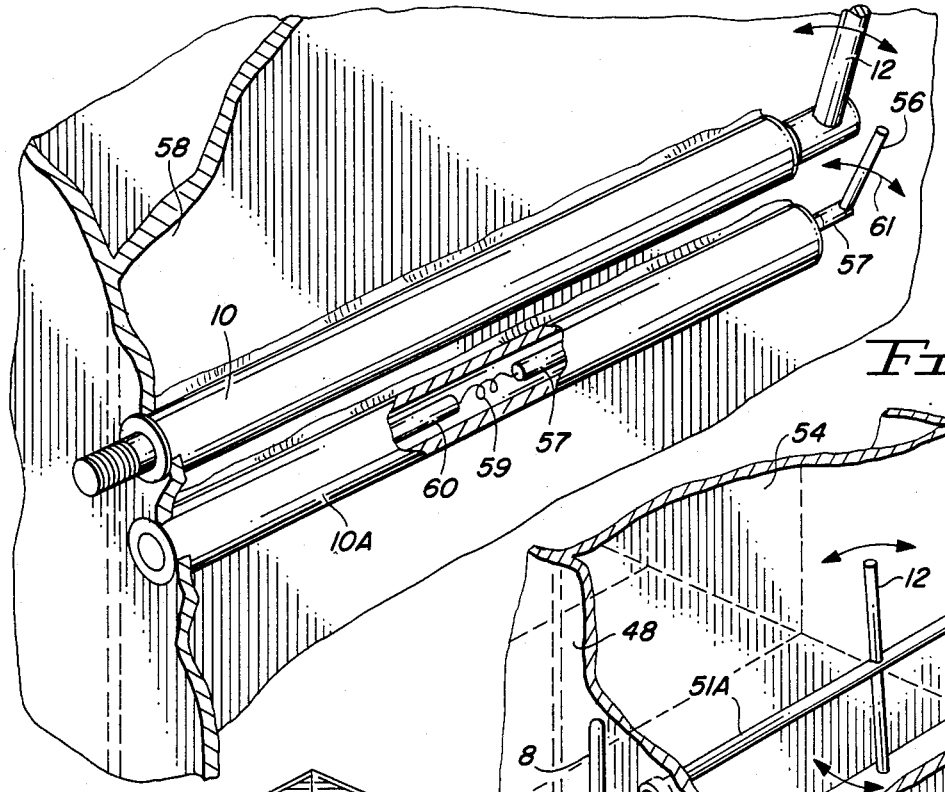
FIG. 12 is a partial perspective cutaway view of another embodiment of the invention.

Referring next to FIG. 12, it may in some instances be necessary to introduce a technique for temperature compensation of the square prism filters other than the technique described above with reference to thermal expansion of cantilever rod 51 and with reference to arrows 55 in FIG. 13. In this event, the structure shown in FIG. 12 includes a second conductive sleeve 10A similar to the sleeve 10 shown in FIGS. 4 and 6. A second smaller Invar tuning element 56 is pivotally connected to a rotatable rod 57 that extends part way through the right end of conductive sleeve 10A, which is soldered along one of the square conductive walls 58 of the square prism filter under consideration. A bi-metal coil 59 is attached to the left hand end of rod 57. The opposite end of the bi-metal coil 59 is attached to another rotatable rod 60. When the temperature of the wall 58 of the square prism filter changes, bi-metal coil 59 twists and, if rod 60 is anchored at its left end, causes freely rotatable rod 57 to rotate and thereby causes the temperature compensating Invar tuning arm 58 to rotate in one of the directions indicated by arrows 61. A lock nut (not shown) and a screwdriver slot (not shown) can be provided on the extreme left end of rod 60 to effectuate initial room temperature tuning or calibration of the square prism filter; the rod 60 then is locked in a desired predetermined orientation by tightening the lock nut.

This technique for bi-metal actuated temperature compensation has the advantage that the bi-metal element 59 is shielded from the electromagnetic radiation inside the square prism filter cavity, so that the electromagnetic radiation does not directly cause heating and displacement of the bi-metal element.

This technique for bi-metal temperature compensation of the square prism filter can be used in conjunction with any of the other techniques described with reference to the other drawings, including the technique of FIGS. 1–8, FIG. 13 and FIG. 14.

It should be noted that when separate bi-metal actuated tuning arms such as 61 are utilized, typically both their lengths and their diameters will be roughly about one-fourth the length and diameter of the main tuning arm 12 used in the same cavity.

Figure 9:
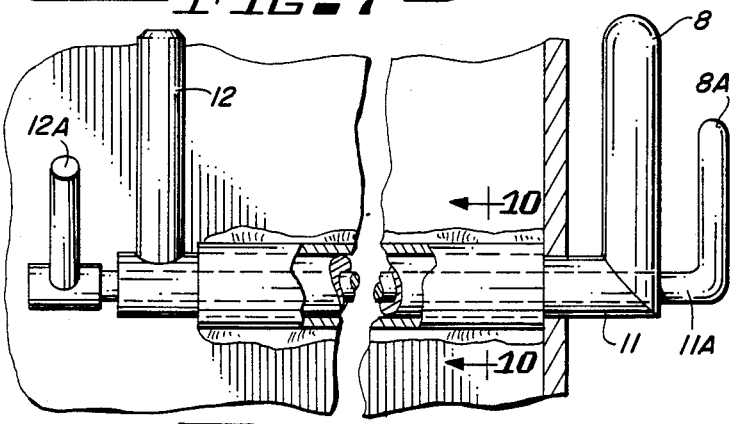
FIG. 9 is a partial cutaway section view of another embodiment of the invention.
Figure 10:
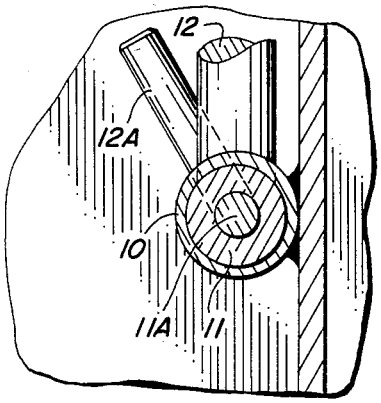
FIG. 10 is a partial section view taken along section line 10—10 of FIG. 9.

Referring next to FIGS. 9 and 10, a modified embodiment of the invention is shown to illustrate the concept of providing horizontal rod 11 as a tubular member and providing a fine tuning rod 12A on the end of a second horizontal pivot rod llA which extends through rod 11 in a concentric fashion and is attached to a fine tuning handle 8A. By making fine tuning rod 12A roughly one-fourth as long as main tuning rod 12 and causing its diameter to be roughly one-fourth that of main tuning rod 12, a precise fine tuning effect can be accomplished by rotation of handle 8A.

Figure 11:
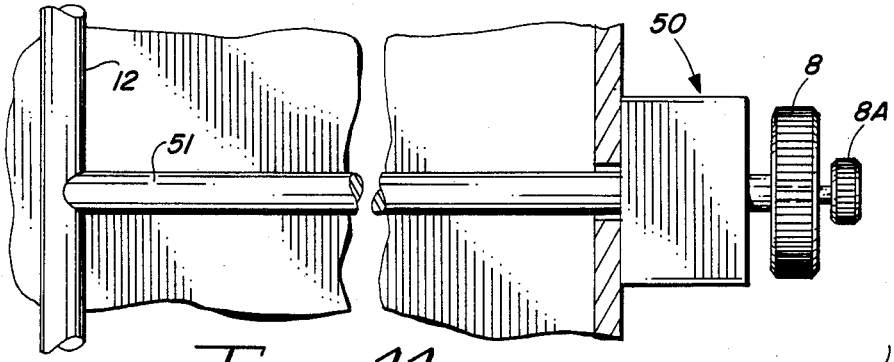
FIG. 11 is a partial section view of another embodiment of the invention.

FIG. 11 illustrates a presently preferred implementation of fine tuning mechanism 50 more clearly than is illustrated in FIG. 13. A reduction mechanism 50 includes a course tuning knob and a fine tuning knob 8A to accomplish coarse and precise rotation, respectively, of Invar tuning rod 12.

With reference to the orientation of the Invar tuning rods 12 showing the various embodiments of the invention, those skilled in the art will recognize that when the axes of the tuning rods 12 are parallel to the square walls of a square prism filter, the effect on the resonant frequency of the square prism filter is negligible, and when the tuning rods 12 are pivoted, the resonant frequency is increased to a maximum value when the tuning rods are perpendicular to the square walls.

It should be appreciated that the requirement for precision tuning at the 880 megahertz frequency range is so sensitive that it is preferable that all of the ground plates referred in FIGS. 15–21 be composed of the same material as the walls of the square prism filter in order to avoid bi-metal effects and consequent warpage of the walls as the temperature of the square prism filter varies over the temperature range of interest.

While the invention has been described with reference to several embodiments, those skilled in the art will be able to make various modifications to the described embodiments of the invention without departing from the true spirit and scope thereof. For example, although precise tuning of the square prism filters from a rectangular wall has been described and accomplished by rotating the Invar tuning arms 12 pivotally in a plane perpendicular to the square walls of the square prism filters, it would be possible to achieve accurate tuning without introducing appreciable insertion loss by moving the tuning element 12 in the direction along the axis of the supporting rods as 51 in FIG. 13. In this event, the tuning element would not even have to be in the shape of a rod but could be different, for example, the shape of a disc on the end of the rod. The rotatable tuning rods, such as 11 and 51 described herein can be composed or dielectric or conductive material, or a combination of both in order to get the desired coefficient of expansion in certain instances. It should noted that if the tuning elements such as 12 are electrically connected or "grounded" to the cavity wall, they must be very reliably so electrically connected. But it is not necessary that the tuning elements 12 be electrically connected to the cavity wall. The invention is also applicable to cubic square prism filters of the type described in U.S. Pat. No. 4,249,148.

We claim:

1. A filter usable in a transmitter combiner comprising:

(a) a housing defining a parallelepiped cavity, said housing including conductive first and second square walls connected to conductive first, second, third and fourth rectangular walls, the spacing between said first and second square walls being less than their edge dimensions;

(b) conductive probe means extending from outside of said housing into said cavity defined therein to excite said filter and produce a standing wave electromagnetic field pattern therein;

(c) a movable tuning element disposed in said cavity for changing the resonant frequency of said standing wave electromagnetic field pattern;

(d) adjustable control means disposed outside of said housing and supported by said first rectangular wall; and (e) coupling means connected between said adjustable control means and said tuning element for converting adjustment of said adjustable control means to corresponding displacement of said movable tuning element to effectuate tuning of said filter by adjustments made from said first rectangular wall, wherein said coupling means includes a first rotatable, conductive rod oriented perpendicular to said first rectangular wall and disposed in a conductive tube attached to the inner surface of said first square wall; and means for attaching said first rotatable rod to said movable tuning element with said element approximately aligned with the midpoint of said first square wall and rotatable in said cavity in response to rotation of said first rotatable rod and further, including conductive bearing means having a first bearing member electrically connected to a conductive inner surface of said housing and a second bearing member electrically contacting said first rotatable tuning rod and disposed in intimate, mating, electrically contacting relation to said first bearing member.

2. The filter of claim 1, wherein said adjustable control means includes calibrated indicating means for indicating precisely the resonant frequency of said filter as a function of the orientation of said movable tuning element.

3. The filter of claim 1 wherein said coupling means includes a second rotatable rod longitudinally aligned with said first rotatable rod and coupled to said adjustable control means to rotate in response to said adjustment of said adjustable control means, and further includes a bi-metal element connected between adjacent end portions of said first and second rotatable rods for causing said movable tuning element to rotate as a function of temperature of said first square wall to cause the resonant frequency of said filter to remain essentially constant despite changes in the dimension of the walls of said housing due to the changes in the temperatures thereof, a conductive tube shielding said bi-metal element from electromagnetic energy in said housing and preventing said electromagnetic energy from directly causing heating of said bi-metal element to a temperature different from the temperature of said first square wall.

4. The filter of claim 1 wherein said first rotatable rod extends only approximately to the center region of said cavity and including electrically conductive bearing means for supporting said first rotatable rod in cantilever fashion from said center of said first rectangular wall.

5. The filter of claim 4 wherein said first rotatable rod has a temperature coefficient that causes enough axial expansion and contraction of the length thereof to cause the resonant frequency of said filter to remain essentially constant despite variation in the dimensions of the walls of said filter due to changes in the temperature thereof.

6. The filter of claim 1 wherein said first rotatable rod extends from said first rectangular wall to said second rectangular wall.

7. The filter of claim 6 wherein said walls are composed of Invar material, and said first rotatable rod is composed of copper.

8. A transmitter combiner comprising (a) a plurality of independently tunable square prism filters with each said square prism filter comprising:

(i) first and second spaced apart square conducting walls joined by four substantially rectangularly shaped conducting walls thereby defining a cavity;

(ii) input means extending from outside of a respective one of said walls into said cavity;

(iii) movable tuning means disposed substantially at the center of said cavity for tuning said filter;

(iv) adjustable control means disposed outside of said filter and supported by a respective one of said rectangular walls; and (v) coupling means connected between said adjustable control means and said tuning means for converting adjustment of said adjustable control means to corresponding displacement of said movable tuning means;

(b) each said filter having a selected square wall common with a respective square wall of another of said filters;

(c) output means affixed to a selected surface of the combiner for coupling said filters in parallel to a common output terminal; and wherein various ones of said plurality of square prism filters each has a rectangular wall in common with another of said square prism filters.

9. A transmitter combiner including:

a plurality of square prism filters, each said filter having:

(a) conductive first and second square walls and conductive first, second, third and fourth rectangular walls connected to form a parallelepiped, the spacing between said first and second square walls being less than their edge dimensions;

(b) conductive probe means extending from the outside to the inside of said parallelepiped to excite said square prism filter and produce a standing wave electromagnetic field pattern therein;

(c) a movable tuning element disposed in said parallelepiped for changing the resonant frequency of said standing wave electromagnetic field pattern;

(d) adjustable control means disposed outside of said parallelepiped and supported by said first rectangular wall;

(e) coupling means connected between said adjustable control means and said tuning element of said square prism filter for converting adjustment of said adjustable control means to corresponding displacement of said movable tuning element, said coupling means including a first rotatable rod oriented perpendicular to said first rectangular wall and means for attaching said tuning element to said first rotatable rod at a point thereof approximately aligned with the midpoint of said first square wall so that said tuning element can pivot in response to rotation of said first rotatable rod; and (f) means for effectuating reliable electrical contact of said tuning element to a conductive inner surface of said parallelepiped;

each said filter having a selected square wall common with a respective square wall of another of said filters, selected ones of said plurality of square prism filters each having a rectangular wall common with a rectangular wall of another of said square prism filters;

a plurality of input coaxial connectors, each said connector coupled, respectively, to a said respective conductive probe means of a said square prism filter for effectuating connection of a plurality of transmitters to the transmitter combiner, said conductive probe means of each of said square prism filters being disposed on a said respective second rectangular wall thereof; and output means for coupling an output signal from each said square prism filter to a selected region of the combiner.

10. The transmitter combiner of claim 9 wherein said output means includes a plurality of signal receiving, conductive, output probes, each of said output probes extending, into a respective one of said square prism filters, an output coaxial connector connectable to a single antenna cable, and first means for coupling said output probes to said output connector to electrically combine the signals from the separate filters.

11. The transmitter combiner of claim 10 wherein said first means includes a strip transmission line arrangement electrically connecting each of said signal receiving conductive output probes to said output connector.

12. A cavity filter usable in a transmitter combiner comprising:

(a) a housing defining a cavity, said housing including conductive first and second square walls and conductive first, second, third and fourth rectangular walls connected to form a parallelepiped enclosing said cavity, the spacing between said first and second square walls being less than their edge dimensions;

(b) conductive probe means extending from outside of said housing into said cavity to excite said filter and produce a standing wave electromagnetic field pattern therein;

(c) a movable tuning element disposed in said cavity for changing the resonant frequency of said standing wave electromagnetic field pattern;

(d) adjustable control means disposed outside of said housing and supported by said first rectangular wall; and (e) coupling means connected between said adjustable control means and said tuning element for precisely converting adjustment of said adjustable control means to corresponding displacement of said movable tuning element;

whereby tuning of said filter can be effectuated by adjustments made from said first rectangular wall and wherein said coupling means includes a first rotatable rod oriented perpendicular to said first rectangular wall and means for attaching said tuning element to said first rotatable rod at a point thereof approximately aligned with the midpoint of said first square wall so that said tuning element can pivot in said cavity in a plane parallel to said first rectangular wall to vary the resonant frequency of said filter in response to rotation of said first rotatable rod and including (f) a second movable tuning element disposed in said cavity, the orientation of which can be varied in a plane parallel to the plane of said first rectangular wall to vary the resonant frequency of said filter, and a second rotatable rod oriented perpendicular to said first rectangular wall and having one end connected to said second tuning element, and bi-metal means connected to another end of said second rotatable rod for causing said second tuning element to rotate as function of the temperature of said first square wall to cause the resonant frequency of said filter to remain essentially constant despite changes in the dimensions of said walls due to the changes in temperature thereof.

13. A cavity filter as in claim 12 wherein said bi-metal means includes a selectively rotatable, lockable support member affixed to said housing; and a bi-metal member coupled between said support member and said another end of said second rotatable rod.

14. A square prism filter comprising in combination:

(a) conductive first and second square walls and conductive first, second, third and fourth rectangular walls connected to form a parallelepiped defining a cavity therein wherein the spacing between said first and second square walls is less than their edge dimensions;

(b) conductive probe means extending from outside of said parallelepiped into said cavity to produce a standing wave electromagnetic field pattern therein;

(c) a rotatable tuning element centrally disposed within said cavity for changing the resonant frequency of said filter;

(d) adjustable control means disposed outside of said parallelepiped adjacent to said first rectangular wall; and (e) coupling means connected between said adjustable control means and said tuning element for converting adjustment of said adjustable control means to corresponding rotation of said centrally disposed, rotatable tuning element, whereby tuning can be effectuated by adjustments made from said first rectangular wall;

wherein said coupling means includes a first conductive, rotatable rod, oriented perpendicular to said first rectangular wall, and coupled to said tuning element with said rod and said tuning element being rotatable to vary the resonant frequency of said filter; and wherein said coupling means includes a second rotatable rod and a second tuning element attached to one end of said second rod, and further includes bi-metal means connected to the other end of said second rotatable rod for causing said second tuning element to rotate as a function of temperature of said first square wall to cause the resonant frequency of said square prism filter to remain essentially constant despite changes in the dimensions of the walls of said square prism filter due to the changes in the temperature thereof, said square prism filter including a conductive tube shielding said bi-metal means from electromagnetic energy therein and preventing said electromagnetic energy from directly causing heating of said bi-metal means to a temperature different than the temperature of said first square wall.

15. The square prism filter of claim 14 wherein said first rotatable rod extends from a geometric center portion of said first rectangular wall into a geometric center region of said square prism filter.

16. A square prism filter as in claim 14 wherein said bi-metal means includes:

a selectively rotatable, lockable support member affixed to a selected one of said walls; and a bi-metal member coupled between said support member and said other end of said second rotatable rod.

17. A cavity filter usable in a transmitter combiner comprising:

a square prism filter, said square prism filter including conductive first and second square walls and conductive first, second, third and fourth rectangular walls connected to form a parallelepiped, the spacing between said first and second square walls being less than their edge dimensions;

conductive probe means extending into said square prism filter for producing a standing wave electromagnetic field pattern therein;

a first movable tuning element disposed in said square prism filter for changing the resonant frequency of said standing wave electromagnetic field pattern;

adjustable control means disposed outside of said square prism filter, supported by said first rectangular wall; and coupling means connected between said adjustable control means and said first tuning element for converting adjustment of said adjustable control means to corresponding displacement of said movable tuning element to tune said square prism filter by adjustments made from said first rectangular wall;

wherein said coupling means further including a first tubular, rotatable rod oriented perpendicular to said first rectangular wall, means for attaching said first tuning element to said first rotatable rod at a point thereof approximately aligned with the midpoint of said first square wall to pivot said tuning element in response to rotation of said first rotatable rod, said first rotatable rod having an inner end to which said first tuning element is connected and an outer end coupled to said control means, and a second rotatable rod extending coaxially through said first rotatable rod and having an inner end extending out of the inner end of said first rotatable rod, and also having an outer end coupled to said control means, and also including a second tuning element connected to said inner end of said second rotatable rod, the orientation of said second tuning element being varied to vary the resonant frequency of said first square prism filter, said second tuning element being connected to a portion of said second rotatable rod and extending out of said inner end of said first rotatable rod, said adjustable control means including coarse tuning control means coupled to said outer end of said first rotatable rod to effect rotation thereof and fine tuning control means coupled to said outer end of said second rotatable rod to effect rotation thereof.

18. A square prism filter comprising:

(a) conductive first and second square walls and conductive first, second, third and fourth rectangular walls connected to form a parallelepiped;

(b) conductive probe means extending from outside of said square prism filter into said square prism filter, respectively, to excite said square prism filter and produce a standing wave electromagnetic field pattern therein;

(c) a movable tuning element disposed within said first square prism filter for changing the resonant frequency of said standing wave electromagnetic field pattern;

(d) adjustable control means disposed outside of said square prism filter adjacent to the first rectangular wall of said square prism filter; and (e) coupling means connected between said adjustable control means and said tuning element for translating adjustments of said adjustable control means to said tuning element, whereby tuning of said square prism filter can be affectuated by adjustments made from said first rectangular wall;

wherein the spacing between said first and said second square walls is less than their edge dimensions, wherein said coupling means includes a first conductive rotatable rod oriented perpendicular to said first wall and coupled between said tuning element and said control means, wherein said first rotatable rod extends from the center of said first rectangular wall only approximately to the center of said square prism filter, and said square prism filter including electrically conductive bearing means for supporting said first rotatable rod in cantilever fashion from said center of said first rectangular wall and wherein said first rotatable rod has a temperature coefficient that causes enough axial expansion and contraction of the length of said first rotatable rod to cause the resonant frequency of said square prism filter to remain essentially constant despite variations in the dimensions of the walls of said square prism filter due to changes in the temperature thereof.

19. A method of tuning a square prism filter including first and second square walls and conductive first, second, third and fourth rectangular walls connected to form a parallelepiped, said method comprising the steps of:

(a) supporting a movable, conductive, tuning element inside of said parallelepiped in approximate alignment with the center thereof by means of a supporting member connected thereto;

(b) extending the supporting member through the center of the first rectangular wall essentially perpendicular thereto;

(c) rotatably supporting the member in cantilever fashion from the first rectangular wall by means of a conductive bearing assembly attached thereto;

(d) rotating said supporting member externally of the parallelepiped to effectuate rotation of the tuning element to thereby alter the resonant frequency of the said square prism filter the method including temperature compensating the resonant frequency of the square prism filter by extending the tuning element into a predetermined region of the square prism filter in response to thermal expansion of the supporting member.

20. A method of tuning a square prism filter including first and second square walls and conductive first, second, third and fourth rectangular walls connected to form a parallelepiped, the parallelepiped including an external control element coupled to an elongated supporting member with a conductive tuning rod attached thereto, the method comprising:

(a) supporting the conductive tuning rod inside the square prism filter in approximate alignment with the geometric center thereof by means of the elongated supporting member connected thereto;

(b) orienting the supporting member perpendicular to the plane of the first rectangular wall and supporting one end thereof by rotatably anchoring it to the first rectangular wall;

(c) applying a force to the external control element thereby causing rotation of the elongated supporting member and tuning rod, thereby altering the resonant frequency of the square prism filter; and including temperature compensating the resonant frequency of the square prism filter.

21. A transmitter combiner comprising:

a plurality of independently tunable filters, each said filter including, (a) a housing defining a cavity, said housing having first and second square, spaced-apart, conducting walls joined by rectangular conducting walls to form a parallelepiped;

(b) input means, affixed to one of said walls, for providing electromagnetic input signals to said filter;

(c) independent adjustment means, rotatably affixed to one of said rectangular walls, including a rotatable tuning element centrally and rotatably located within said cavity, in a region of high electric field, for independently tuning said filter; and including conductive means for combining, in parallel, at a common output terminal, electromagnetic output signals from each said filter with each said filter positioned adjacent to at least a second, essentially identical filter.

22. The combiner as in claim 21 with said filters positioned with substantially all of said adjustment means extending from a selected surface and with selected adjacent filters sharing a common, square, conducting wall.

23. The combiner as in claim 21 with each said adjustment means including temperature compensation means so as to vary a selected parameter thereof in response to ambient temperature changes thereby compensating for temperature induced changes in said respective square walls so as to maintain a selected resonant frequency within each said filter.

24. The combiner as in claim 23 with each said adjustment means including a rotatable control rod of a selected length and said temperature compensation means including means for varying said length in response to ambient temperature changes.

25. The combiner as in claim 23 with each said adjustment means including a temperature compensation tuning element and said temperature compensation means including means for rotating said element in response to ambient temperature changes.

26. The combiner as in claim 21 with each said adjustment means including a control rod rotatably-mounted within a conductive tube affixed to a respective one of said square side walls within said cavity.

27. The combiner as in claim 21 wherein each said adjustment means includes a control rod rotatably supported from the center of a said respective rectangular wall so as to extend into said cavity.

28. A transmitter combiner comprising:

a plurality of filters, each said filter including, (a) a housing defining a cavity, said housing having first and second square, spaced-apart, conducting walls joined by rectangular conducting walls to form a parallelepiped;

(b) input means, affixed to one of said walls, for providing electromagnetic input signals to said filter;

(c) adjustment means, rotatably affixed to one of said rectangular walls, including a rotatable tuning element centrally and rotatably located within said cavity, in a region of high electric field, for tuning said filter; and including conductive means for combining, in parallel, at a common output terminal, electromagnetic output signals from each said filter with each said filter positioned adjacent to at least a second, essentially identical filter;

each said adjustment means extending into a respective one of said cavities, essentially perpendicular to a said respective rectangular wall, with a said respective tuning element affixed essentially perpendicular thereto and with selected adjacent filters sharing a common, rectangular conducting wall.

* * * * *